US006898294B2

(12) United States Patent
Sekiguchi et al.

(10) Patent No.: US 6,898,294 B2
(45) Date of Patent: May 24, 2005

(54) MICROPHONE SET

(75) Inventors: Toru Sekiguchi, Yamanashi-ken (JP); Tsutomu Ojima, Iwate-ken (JP)

(73) Assignees: Citizen Electronics Co., Ltd., Fujiyoshida (JP); Citizen Iwate Co., Ltd., Morioka (JP)

( * ) Notice: Subject to any disclaimer, the term of this patent is extended or adjusted under 35 U.S.C. 154(b) by 0 days.

(21) Appl. No.: 10/142,799

(22) Filed: May 13, 2002

(65) Prior Publication Data

US 2002/0172388 A1 Nov. 21, 2002

(30) Foreign Application Priority Data

May 17, 2001 (JP) ..... 2001-148458

(51) Int. Cl.[7] ..... H04R 25/00
(52) U.S. Cl. ..... 381/369; 381/361; 381/368

(58) Field of Search ..... 381/322, 328, 381/360–362, 358, 368–369, 355, 363, 364, 365, 170, 175; 379/433

(56) References Cited

U.S. PATENT DOCUMENTS

| | | | | |
|---|---|---|---|---|
| 3,414,689 A | * | 12/1968 | Gummel et al. | 381/344 |
| 5,825,896 A | * | 10/1998 | Leedom | 381/322 |
| 6,285,772 B1 | * | 9/2001 | Tate et al. | 381/357 |
| 6,359,993 B2 | * | 3/2002 | Brimhall | 381/328 |
| 6,522,759 B1 | * | 2/2003 | Mori | 381/150 |

* cited by examiner

*Primary Examiner*—Suhan Ni
(74) *Attorney, Agent, or Firm*—Dennison, Schultz, Dougherty & MacDonald

(57) ABSTRACT

A microphone set comprises a microphone assembly having a square pillar shape, and a tube which has a cylindrical shape and covers the side wall of the microphone assembly.

2 Claims, 8 Drawing Sheets

MICROPHONE SET

BACKGROUND OF THE INVENTION

The present invention relates to a microphone set, and more particularly to a small microphone set used in a small electronic instrument such as a portable telephone.

FIG. 5 is a sectional view showing a conventional one-piece microphone assembly, and FIG. 6 is an exploded perspective view of the microphone assembly.

The one-piece microphone assembly comprises a condenser microphone 1, a connector 2 secured to the underside of the microphone 1, and a gasket 4 made of elastomer such as silicon rubber and urethane rubber. Each of the connector 2 and the gasket 4 has a dish-like shape, so that the microphone is enclosed by these members. The condenser microphone 1 comprises a substrate, a back plate having a back electrode and a frame having a diaphragm electrode S. These members are mounted in a case 6.

The connector 2 is made of resin and has a terminal 3 embedded therein so as to be connected to a terminal of an electronic instrument such as a portable telephone when assembled. The gasket 4 is provided for acoustically shielding around the diaphragm electrode 5, and has a sound collection hole 4*a,*

FIG. 7 is a sectional view showing another one-piece microphone assembly similar to the above described microphone assembly.

The microphone assembly comprises the microphone 1, a connector 7, and a cylindrical gasket 8. The microphone 1 is also enclosed by the connector 7 and the gasket S.

In the conventional microphone assemblies, the gasket, microphone and connector are manufactured at different manufacturers, respectively. These parts are assembled by a final assembling factory. Consequently, there are troubles about storage management of parts and the number of assembling steps.

FIG. 9 shows a microphone assembly which resolves the above described troubles.

Referring to FIG. 8, the condenser microphone assembly 10 comprises a microphone 11, a connector 12 secured to the underside of the microphone 11 and a gasket 14 secured to the upper surface of the microphone 11. As shown in FIGS. 9*a* to 9*c*, each of these members has a square in plan view. Therefore, the microphone assembly has a cubic shape or square pillar shape.

Referring to FIG. 10, the microphone 11 comprises a substrate 15 having printed circuits, a field-effect transistor (FET) 16 securely mounted on the substrate 15, having terminal electrodes on the underside thereof, a back plate 17 having a recess is for the FET 16 and vents 20 and secured to the substrate 15, a stationary back electrode 21 securely mounted on the surface of the back plate 17, a diaphragm electrode 23 as a movable electrode secured to a spacer 24 mounted on the back plate 17, and a frame 22 mounted on the diaphragm electrode 23. The spacer 24 has an opening 25. The substrate 15, back plate 17, and frame 22 are made of ceramic. The stationary back electrode 21 and the diaphragm electrode 23 form a condenser.

The connector 12 is made of anisotropic conductive elastomer and includes a plurality of gold wires or metal powders therein for electrically connecting the terminal electrodes of the substrate 15 of the microphone 11 and terminals of an electronic instrument in which the microphone assembly is to be mounted. On the underside of the connector 12, there is provided a plurality of projections 12*a* which are formed so as to increase local contact pressure against the terminals of the instrument and to ensure the connection there-between.

Although the microphone assembly 10 has various advantages, the microphone assembly has a cubic shape or a square pillar shape, since the assembly is manufactured by cutting the assembly aggregation. There is a case that the microphone assembly having a cubic shape can not be mounted in an electronic instrument because the space for holding the assembly has a cylindrical shape.

SUMMARY OF THE INVENTION

An object of the present invention is to provide a microphone assembly having a cubic shape which can be mounted in a cylindrical shape of an instrument.

According to the present invention, there is provided a microphone set comprising a microphone having a square pillar shape, a tube having a cylindrical shape and covering a side wall of the microphone.

The tube is made of an elastic material.

The present invention further provides a microphone assembly having a square pillar shape, and a tube having a cylindrical shape and covering a side wall of the microphone assembly.

The microphone assembly comprises a microphone, a connector secured to an underside of the microphone, and a gasket secured to an upper surface of the microphone.

These and other objects and features of the present invention will become more apparent from the following detailed description with reference to the accompanying drawings.

DETAILED DESCRIPTION OF THE PREFERRED EMBODIMENT

Figure 1:
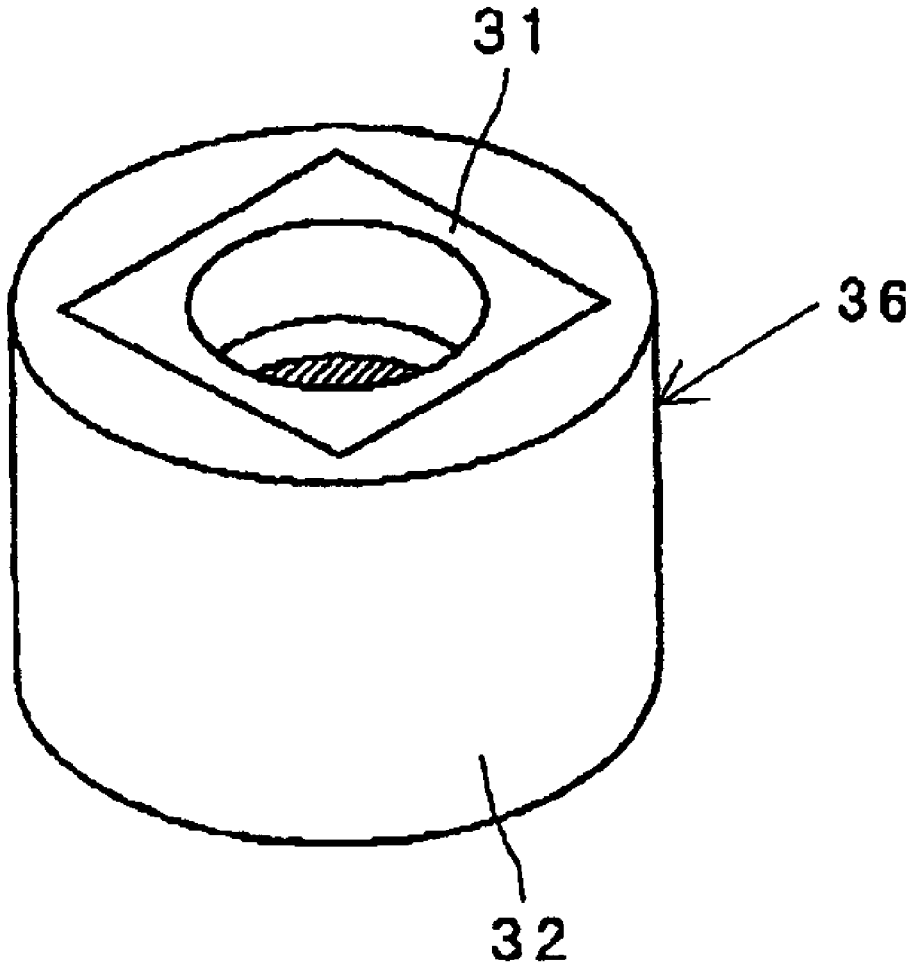
FIG. 1 is a perspective view of a microphone set of the present invention.
Figure 2:
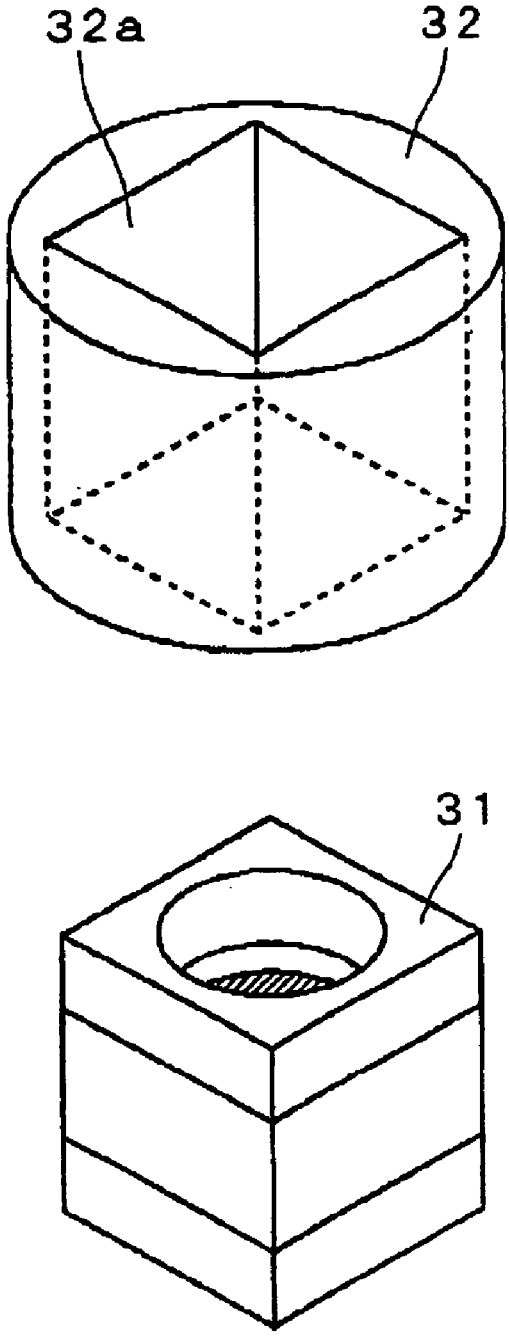
FIG. 2 is an exploded perspective view of a microphone set.
Figure 8:
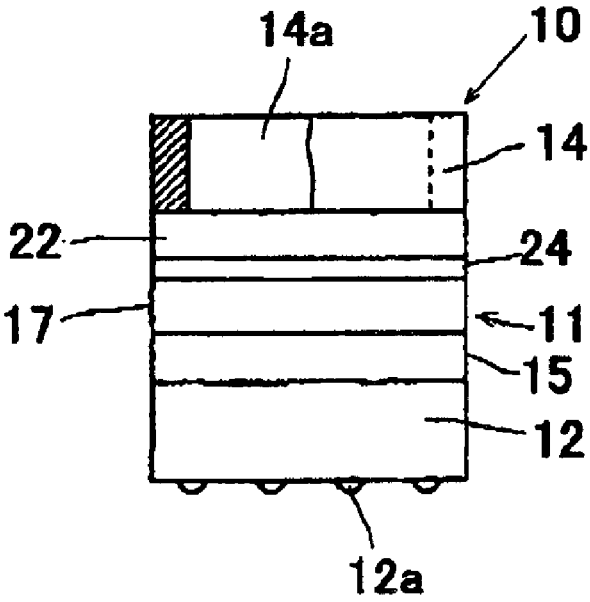
FIG. 8 is a side view of an improved microphone assembly.
Figure 9A:
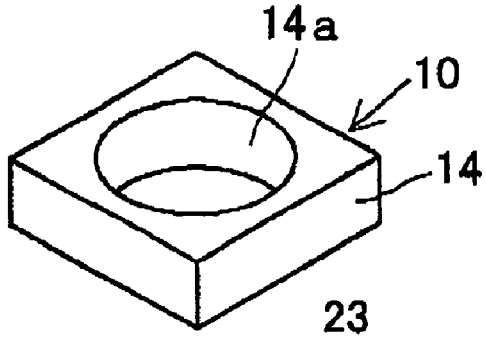
FIGS. 9*a* thorough 9*c* are exploded perspective views of the microphone assembly.
Figure 9B:
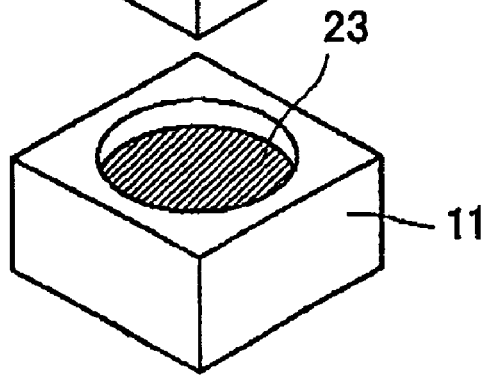
Figure 9C:
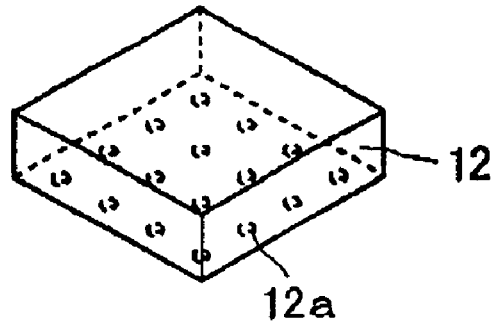
Figure 10:
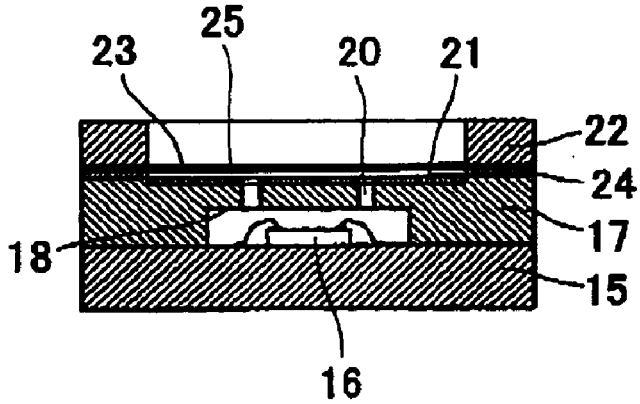
FIG. 10 is a sectional view of a microphone as an example used in the microphone assembly.

Referring to FIG. 1 showing a perspective view of a microphone assembly according to the present invention, a microphone assembly 31 is the same as the microphone assembly shown in FIG. 8 in shape and construction. Namely, the microphone has a square pillar shape as shown in FIG. 2. The microphone is covered by a tube 32 made of elastomer such as silicon rubber, polyurethane rubber, thereby providing a microphone set 36.

As shown in FIG. 2, the tube 32 has a hole 32*a* of a square pillar shape. Since the tube 32 has elasticity, the hole 32*a* is formed into a size slightly smaller than that of the microphone 31. Therefore, the microphone 31 is held by a proper pressure without adhesive.

Figure 3A:
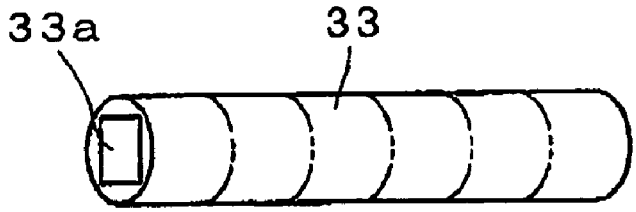
FIGS. 3*a* and 3*b* are perspective views showing a manufacturing steps of tubes.
Figure 3B:
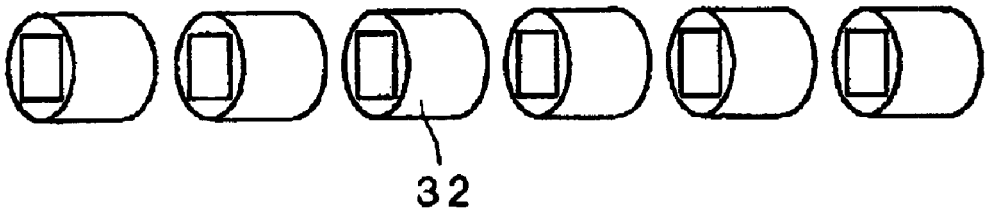

FIGS. 3*a* and 3*b* show a mass production method of the tube. A tube aggregation 33 having a long cylindrical shape is prepared. A through hole 33*a* having a square pillar shape is formed in the tube aggregation 33. As shown in FIG. 3*b*, the tube aggregation 33 is cut in at every tube. Thus, a plurality of tubes 32 are manufactured.

Figure 4A:
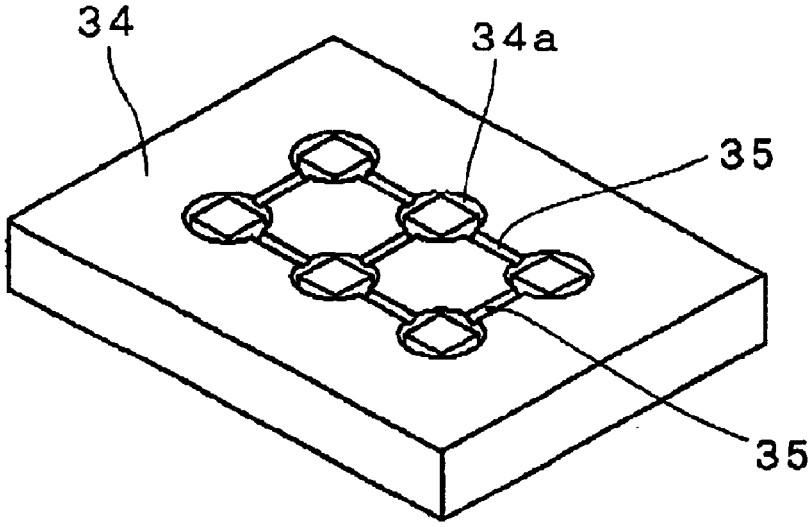
FIGS. 4*a* to 4*c* show other manufacturing steps.
Figure 4B:
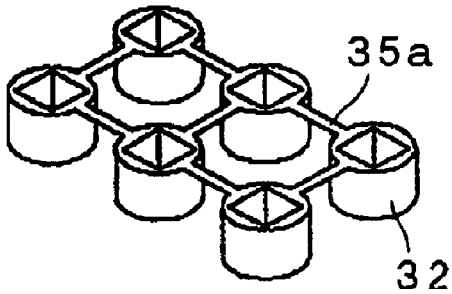
Figure 4C:
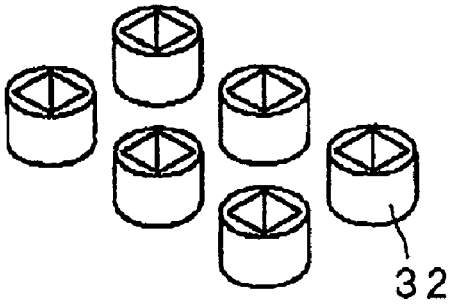
Figure 5:
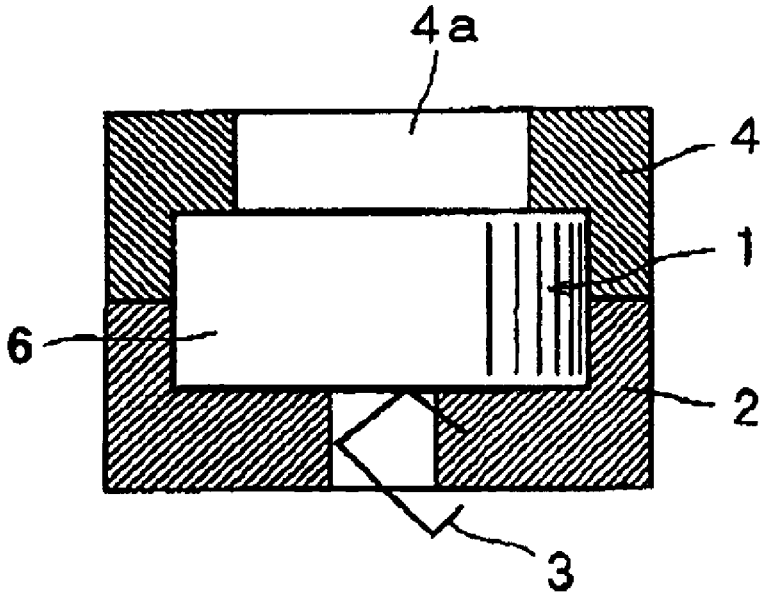
FIG. 5 PRIOR ART
FIG. 5 is a sectional view of a conventional microphone assembly.
Figure 6:
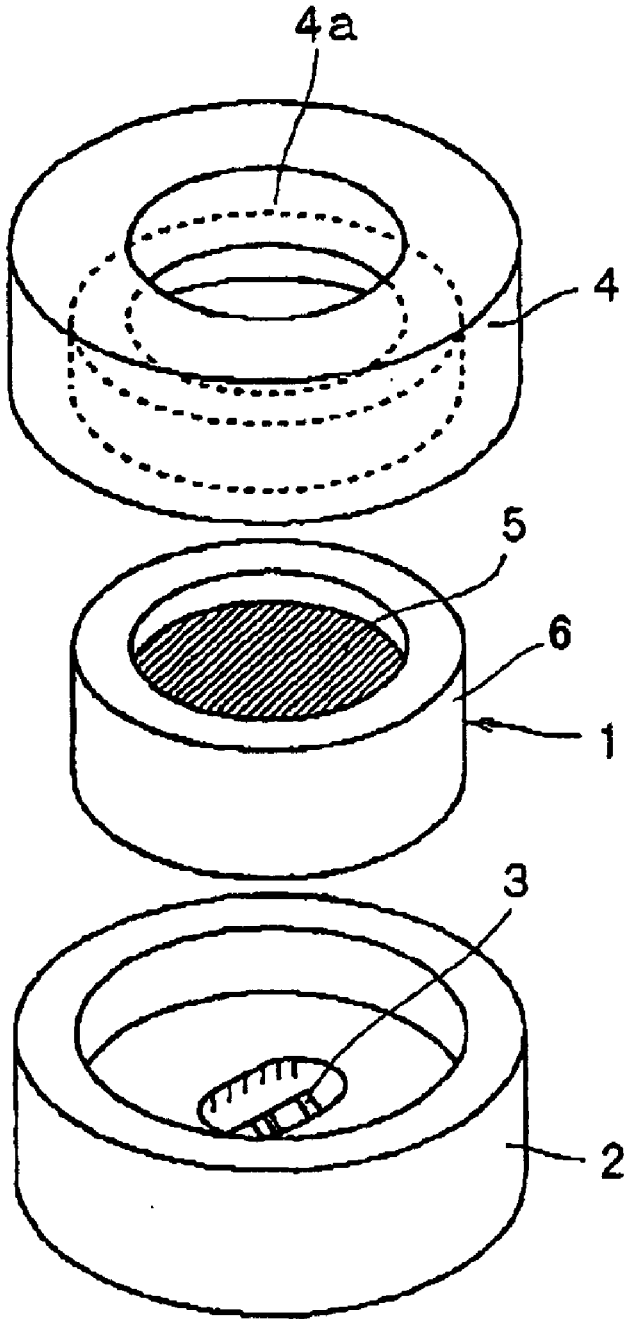
FIG. 6 PRIOR ART
FIG. 6 is an exploded perspective view of the microphone assembly.
Figure 7:
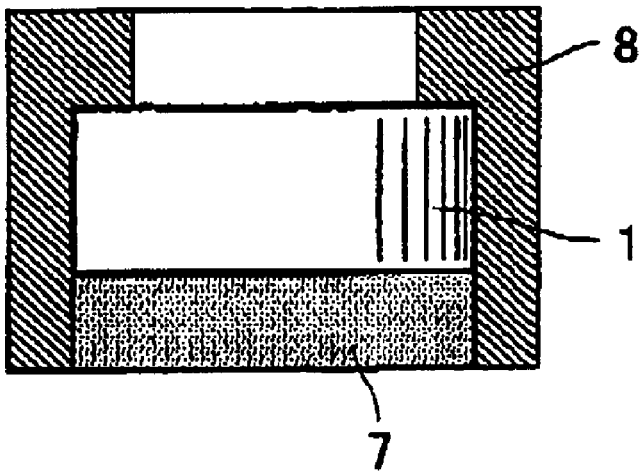
FIG. 7 PRIOR ART
FIG. 7 is a sectional view of another conventional microphone assembly.

FIGS. 4*a*, 4*b* and 4*c* show another method for manufacturing tubes. In the method, a mold 34 is prepared. A plurality of cavities 34*a* each of which has a shape according to the tube are provided in the mold. Adjacent cavities 34*a* are connected by grooves 35.

As shown in FIG. 4*b*, produced tubes 32 are connected by branches 35. By cutting off the branches 35 from the tube, a plurality of tubes 32 are manufactured as shown in FIG. 4*c*.

In accordance with the present invention, although the microphone assembly has a cubic shape, the microphone set having a cylindrical shape can be easily produced.

While the invention has been described in conjunction with preferred specific embodiment thereof, it will be understood that this description is intended to illustrate and not limit the scope of the invention, which is defined by the following claims.

What is claimed is:

1. A microphone set, comprising:

a microphone including a frame having an outer square pillar shape;

a diaphragm supported in the frame;

an independent tube made of elastic and non-porous material having an outer cylindrical shape and having a hole of a square pillar shape therethrough; and wherein the microphone is disposed in the hole of the tube so that the microphone is fixed to the tube so as to expose the diaphragm in the hole of the tube.

2. The microphone set according to claim 1, wherein the hole of the tube has a size smaller than the size of the square pillar shape of the frame of the microphone, so that the outside wall of the frame of the microphone is pressed against the inside wall of the hole of the tube.

* * * * *

UNITED STATES PATENT AND TRADEMARK OFFICE

CERTIFICATE OF CORRECTION

PATENT NO. : 6,898,294 B2
DATED : May 24, 2005
INVENTOR(S) : Sekuguchi et al.

It is certified that error appears in the above-identified patent and that said Letters Patent is hereby corrected as shown below:

Title page,
Item [73], Assignee, replace: "Citizen Electronics Co., Ltd.
Citizen Iwate Co., Ltd."
to reflect only:
-- Citizen Electronics Co., Ltd. --.

Signed and Sealed this

Thirteenth Day of December, 2005

JON W. DUDAS
*Director of the United States Patent and Trademark Office*